US009783959B2

(12) United States Patent
Schifferer et al.

(10) Patent No.: US 9,783,959 B2
(45) Date of Patent: Oct. 10, 2017

(54) METHOD OF OPERATING RIDE CONTROL SYSTEM

(71) Applicant: Caterpillar Inc., Peoria, IL (US)

(72) Inventors: Andrew N. Schifferer, Batavia, IL (US); Eric W. Cler, Oswego, IL (US); Eric C. Hughes, Metamora, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 15/135,342

(22) Filed: Apr. 21, 2016

(65) Prior Publication Data

US 2016/0237652 A1 Aug. 18, 2016

(51) Int. Cl.
*E02F 9/20* (2006.01)
*E02F 9/22* (2006.01)

(52) U.S. Cl.
CPC ..... *E02F 9/2095* (2013.01); *E02F 9/2207* (2013.01); *E02F 9/2217* (2013.01)

(58) Field of Classification Search
CPC ..... E02F 9/2095; E02F 9/2207; E02F 9/2217
See application file for complete search history.

(56) References Cited

U.S. PATENT DOCUMENTS

| | | | |
|---|---|---|---|
| 5,116,188 | A | 5/1992 | Kurohashi et al. |
| 5,520,499 | A | 5/1996 | Ufheil et al. |
| 5,733,095 | A | 3/1998 | Palmer et al. |
| 7,243,494 | B2 | 7/2007 | Evans |
| 7,703,280 | B2 | 4/2010 | Kobayashi et al. |
| 8,538,640 | B2 | 9/2013 | Ota |
| 8,548,692 | B2 | 10/2013 | Morimoto et al. |
| 9,091,039 | B2 | 7/2015 | Dobchuk et al. |
| 2014/0238007 | A1 | 8/2014 | Payne |
| 2014/0379229 | A1 | 12/2014 | Walz et al. |

*Primary Examiner* — Michael D Lang

(57) ABSTRACT

A method of operating a ride control system of a machine having an accumulator is provided. The method includes detecting a pressure at the accumulator. The method includes generating a first set of input data associated with a drive system and a brake pedal. The method includes generating a second set of input data associated with a lift cylinder. The method also includes determining a working mode of the ride control system based on the first set of input data and the second set of input data. The working mode of the ride control system includes a normal mode and an exposed mode. The method includes operating a ride control activation solenoid valve, upon determining the pressure at the accumulator to be above a predefined threshold, and the working mode of the ride control system to be the exposed mode.

1 Claim, 5 Drawing Sheets

METHOD OF OPERATING RIDE CONTROL SYSTEM

TECHNICAL FIELD

The present disclosure relates to a ride control system, and more particularly to a method of operating a ride control system of a machine.

BACKGROUND

Generally, machines, such as wheel loaders, excavators, etc., are employed at a worksite for moving material/load from one place to another. Such machines include implements for carrying the load. The implements are connected to a frame of the machine. Typically, one or more actuators are connected to the implements to enable movement of the implements with respect to the machine and a ground surface. During movement of the machine, a weight of the loaded implement reacts to the machine while encountering rough terrain or other obstacles. Due to this reaction the machine may lope or bounce. Further, a substantial inertia of the load carried by the implement may cause increased wear of various components, such as a suspension system of the machine and discomfort for an operator of the machine. In order to eliminate the lope or the bounce, a ride control system is implemented in the machine. The ride control system absorbs pressure fluctuations in the one or more actuators that would otherwise be acting on the machine and causing the loping or bouncing.

U.S. Pat. No. 7,703,280, hereinafter referred to as '280 patent, describes a hydraulic ride control system for a working vehicle such as, a wheel loader. The hydraulic ride control system includes boom cylinders and an actuator control valve for controlling a pressure in bottom pressure chambers of the boom cylinders. The hydraulic ride control system further includes an accumulator connected to the bottom pressure chambers of the boom cylinders via a connection line, and an opening control valve having a pilot chamber for selectively communicating or cutting off the connection line depending on a pressure in the pilot chamber. The hydraulic ride control system also includes a selector unit for selectively feeding a pressure to or draining a pressure from the pilot chamber. The selector unit includes a controller for variably controlling an opening of the opening control valve. However, the '280 patent does not describe protection of the ride control system.

SUMMARY OF THE DISCLOSURE

In one aspect of the present disclosure, a method of operating a ride control system of a machine having an accumulator is provided. The method includes detecting, by a first set of sensors, a pressure at the accumulator. The method includes generating, by a second set of sensors, a first set of input data associated with a drive system of the machine and a brake pedal of the machine. The method includes generating, by a third set of sensors, a second set of input data associated with a lift cylinder of the machine. The method also includes determining, by a controller, a working mode of the ride control system. The working mode of the ride control system is determined based on at least one of the first set of input data and the second set of input data. The working mode of the ride control system includes a normal mode and an exposed mode. The method further includes operating a ride control activation solenoid valve, upon determining the pressure at the accumulator to be above a predefined threshold, and the working mode of the ride control system to be the exposed mode. The operation of the ride control activation solenoid valve selectively activates and deactivates the ride control system.

Other features and aspects of this disclosure will be apparent from the following description and the accompanying drawings.

DETAILED DESCRIPTION

Figure 1:
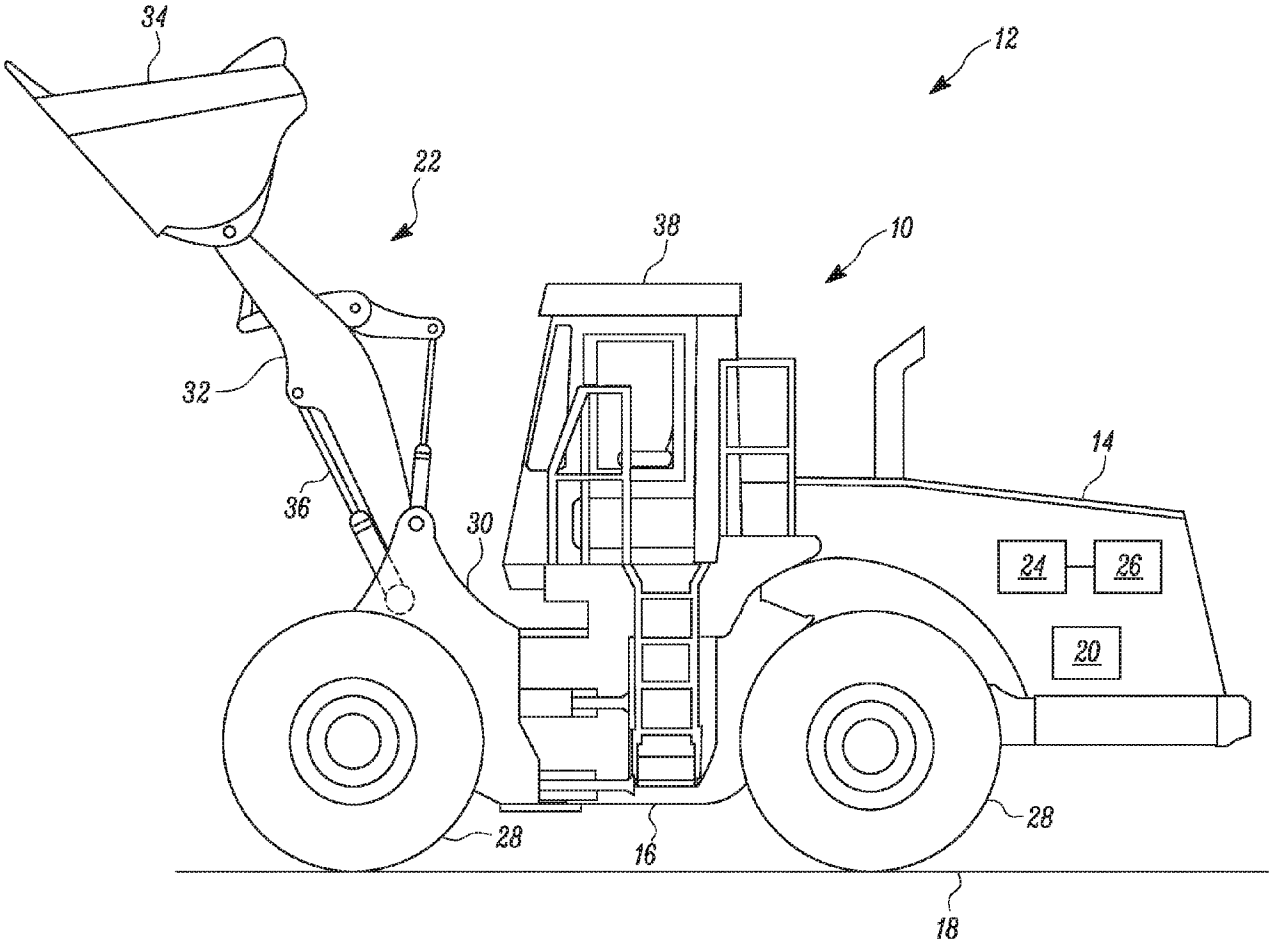
FIG. 1 is a diagrammatic representation of a machine operating at a worksite, according to an embodiment of the present disclosure.

Wherever possible, the same reference numbers will be used throughout the drawings to refer to the same or the like parts. FIG. 1 illustrates a side view of a machine 10 operating at a worksite 12, according to an embodiment of the present disclosure. The machine 10 of the present disclosure is a wheel loader machine. However, it may be contemplated that the machine 10 may alternatively be an excavator, a backhoe loader, a front shovel, a dragline excavator, a crane, or any another similar machine, without departing from the scope of the present disclosure.

The machine 10 includes a drive system. The machines also includes a hood enclosure 14, a frame 16 for supporting the hood enclosure 14 of the machine 10 over a ground surface 18. The drive system includes, but is not limited to, a transmission system (not shown), drive shafts (not shown), wheels 28, and a power source 20 for powering the machine 10. The machine also includes an implement system 22 coupled to the frame 14, a ride control system 24, and a regulating unit 26 for regulating the ride control system 24.

The wheels 28 are in contact with the ground surface 18. The wheels 28 may be drawing power from the power source 20. The power source 20 of the drive system supplies power to various components of the machine 10, such as system the implement system 22. The power source 20 may be an internal combustion engine, for example, a diesel engine, a gasoline engine, a gaseous fuel engine, or any other type of combustion engine known in the art.

The implement system 22 is connected to a front end 30 of the frame 14. The implement system 22 includes a boom member 32 and an implement 34 pivotally connected to the boom member 32. The boom member 32 is pivotally connected to the front end 30 of the frame 14. The boom member 32 is moved relative to the frame 14 for carrying out operations of the implement system 22. The movement of the implement system 22 relative to the frame 14 is caused by one or more lift cylinders 36.

The lift cylinders 36 are connected between the front end 30 of the frame 14 and the implement system 22. The lift cylinders 36 of the machine 10 are fluidly connected to the ride control system 24. The ride control system 24 also include, but is not limited to, accumulators (not shown), valves (not shown), pumps (not shown), and reservoirs (not shown). The ride control system 24 is operated by the regulating unit 26, based on a working mode of the ride control system 24. The working mode of the ride control system 24 includes, but is not limited to, a normal mode and an exposed mode.

The normal mode of the ride control system 24 is indicative of an exposure of the ride control system 24 to high pressure in operating conditions such as, but are not limited to, a movement of the machine 10 on the ground surface 18 with a heavy load in the implement 34, a lifting of the heavy load, and other operations of the machine 10 that are assisted by the ride control system 24 known in the art. On the other hand, the exposed mode of the ride control system 24 is indicative of an exposure of the ride control system 24 to high pressure in operating conditions such as, but are not limited to, a ground engagement of the implement 34, a sustained lift cylinder stall when the machine 10 is stationary, and any sustained high pressure operations of the machine 10 that are not assisted by the ride control system 24 known in the art. The structural and operational characteristics of the ride control system 24 and the regulating unit 26 are explained in detail in the description of FIG. 2, FIG. 3, and FIG. 4 of the present disclosure.

The machine 10 further includes an operator cab 38 for accommodating an operator to control operations of the machine 10. The operator cab 38 encloses various control equipment (not shown) for the operator to control the operations of the machine 10. The control equipment includes, but is not limited to one or more levers, pedals, and a display unit for controlling the machine 10 in response to inputs from the operator.

Figure 2:
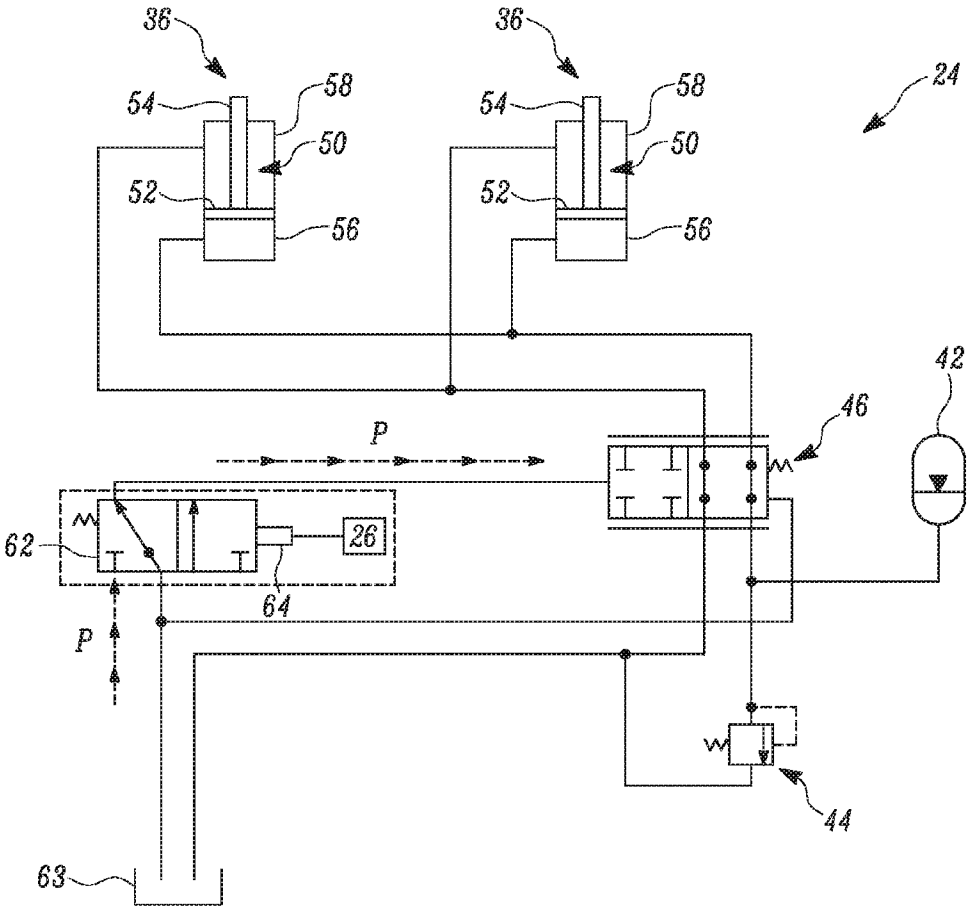
FIG. 2 is a schematic diagram of a ride control system with a regulating unit of the machine of FIG. 1, when the ride control system is operating in a normal mode, according to an embodiment of the present disclosure.

FIG. 2 illustrates a schematic diagram of the ride control system 24 with the regulating unit 26, when the ride control system 24 is operating in the normal mode. The ride control system 24 includes an accumulator 42, an accumulator relief valve 44, a ride control activation spool 46, and a pump 48. The ride control system 24 is a hydraulic control system for controlling a flow of the hydraulic fluid between the lift cylinders 36, the accumulator 42, the accumulator relief valve 44, the ride control activation spool 46, and the pump 48.

In the present embodiment, the machine 10 includes two lift cylinders 36 causing the relative movement of the implement system 22. It may be contemplated that the ride control system 24 may be connected to a single lift cylinder 36 or more than two lift cylinders 36, without departing from the scope of the present disclosure. Each of the lift cylinders 36 includes a piston rod assembly 50 further including a piston 52 and a rod 54. Each lift cylinder 36 further includes ahead end chamber 56 and a rod end chamber 58 separated by the piston rod assembly 50. The head end chamber 56 and the rod end chamber 58 accommodate the hydraulic fluid for compression. The lift cylinders 36 are further fluidly connected to the accumulator 42 through the ride control activation spool 46. In particular, the head end chambers 56 of the lift cylinders 36 are fluidly connected to the accumulator 42 through the ride control activation spool 46.

The accumulator 42 is adapted to store pressurized hydraulic fluid at a pre-defined threshold value. Although the present embodiment includes one accumulator 42, it should be appreciated that the number of accumulators 42 may vary based on various factors, such as operational characteristics and dimensional characteristics of the machine 10 and the ride control system 24. The accumulator 42 is fluidly connected to the accumulator relief valve 44. In case the pressure in the accumulator 42 exceeds the pre-defined threshold value, the accumulator relief valve 44 is adapted to release the excess pressure from the accumulator 42. In one example, the accumulator relief valve 44 is a pilot-operated spring-actuated single-stage valve.

In order to control a passage of the hydraulic fluid from the lift cylinders 36 to the accumulator 42 and the accumulator relief valve 44, the ride control activation spool 46 is provided. The ride control activation spool 46 is a pilot-operated valve. When the ride control activation spool 46 is in an open-state, the hydraulic fluid from the lift cylinders 36 is allowed to reach the accumulator 42. When the ride control activation spool 46 is in a closed-state, the passage of the hydraulic fluid from the lift cylinders 36 to the accumulator 42 and the accumulator relief valve 44 is blocked.

The switching of the ride control activation spool 46 between the open-state and the closed-state is controlled by the regulating unit 26. The regulating unit 26 may be associated with a ride control activation solenoid valve 62 and in communication with the controller 60 (shown in FIG. 3). The controller 60 is adapted to control an opening and closing of the ride control activation solenoid valve 62. In the present embodiment, the ride control activation solenoid valve 62 is an electro-hydraulic pilot valve. In particular, the ride control activation solenoid valve 62 includes a solenoid 64 which is in an electrical communication with the controller 60. The activation and deactivation of the solenoid 64, in turn, opens and closes the ride control activation solenoid valve 62, respectively. Based on data received from a plurality of sensors (not shown), the controller 60 activates the solenoid 64. The operational characteristics of the controller 60 are explained in detail in the description of FIG. 3.

In one example, the ride control activation solenoid valve 62 is fluidly connected to the ride control activation spool 46. When the ride control activation solenoid valve 62 is open, the ride control activation solenoid valve 62 provides a pilot flow "P" to the ride control activation solenoid valve 46, which would in turn control the switching of the ride control activation spool 46 between the open-state and the closed-state.

In one example of the normal mode, when the implement system 22 is raised, a weight of the implement system 22 and a weight of the material carried by the implement system 22 causes movement of the pistons 52 of the lift cylinders 36. Due to the movement of the piston 52, the hydraulic fluid filled in the head end chamber 56 of the lift cylinders 36 is exposed to a high pressure. The hydraulic fluid at the rod end chamber 58 is open to the fluid reservoir 63 through the ride control activation spool 46. The pressurized hydraulic fluid in the head end chamber 56 is directed to the accumulator 42 and the accumulator relief valve 44 through the ride control activation spool 46. In some examples, the accumulator relief valve 44 redirects the hydraulic fluid from the head end chamber 56 to the fluid reservoir 63.

Figure 3:
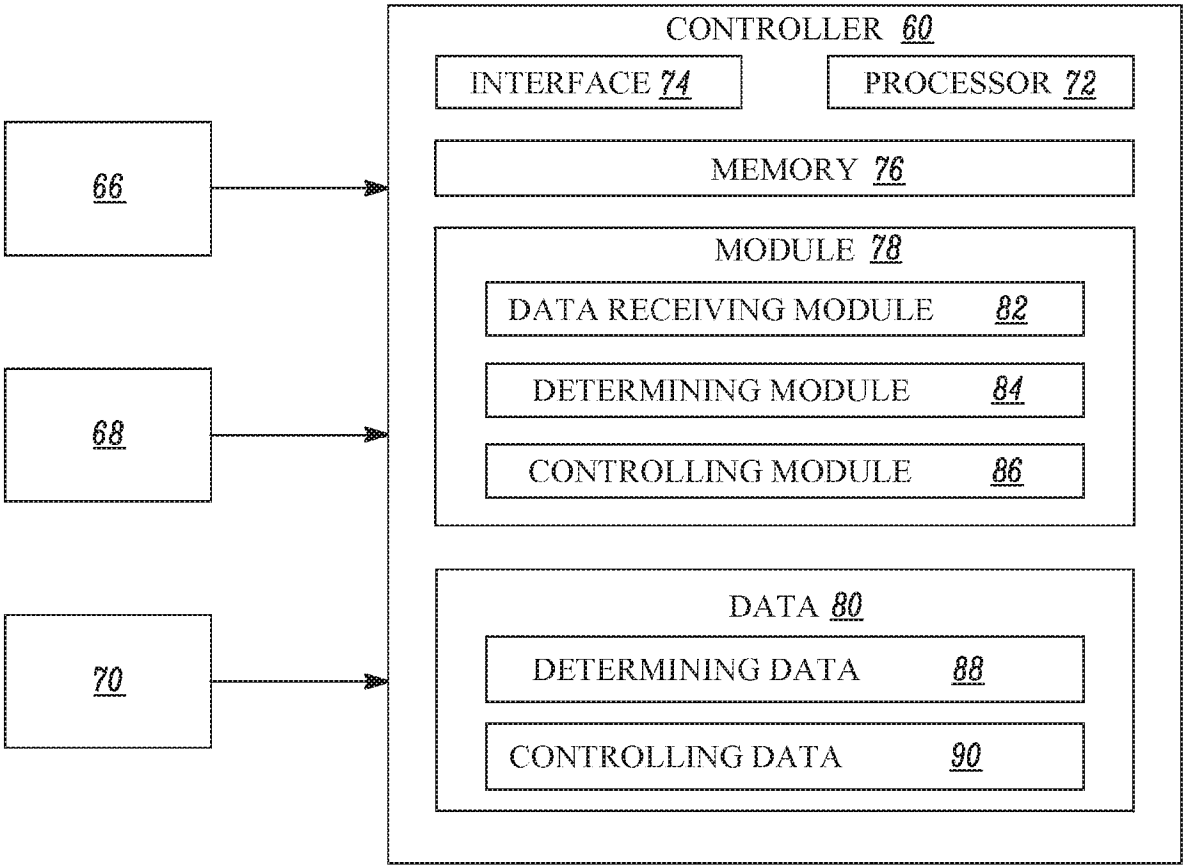
FIG. 3 is a block diagram of a controller of the regulating unit in communication with a plurality of sensors, according to an embodiment of the present disclosure.

FIG. 3 illustrates a block diagram of the controller 60 of the regulating unit 26 in communication with a first set of sensors 66, a second set of sensors 68, and a third set of sensors 70. The first set of sensors 66 is in communication with the pump 48 to determine the pump discharge pressure. In some other examples the first set of sensors 66 may be in communication with the accumulator 42 of the ride control system 24 to detect a pressure at the accumulator 42.

The second set of sensors 68 is in communication with the drive system and the brake pedal of the machine 10 for detecting various operating parameters associated with the drive system and the brake pedal. In one example, the second set of sensors 68 that are associated with the drive system includes one or more of a transmission gear sensor, a transmission gear status sensor, a transmission torque sensor, a transmission torque status sensor, an articulation angle sensor, an articulation angle status sensor, a ground speed sensor, and a ground speed status sensor. Further, the second set of sensors 68 may optionally be associated with the brake pedal and includes one or more of, a left pedal position sensor, a left pedal position status sensor, and a transmission output speed status sensor. It may be contemplated by a person skilled in the art that one or more of such sensors may be eliminated by determining corresponding values by indirect means. Based on the detection, the second set of sensors 68 generates a first set of input data associated with at least one of the drive system and the brake pedal. For example, the transmission gear sensor, the transmission gear status sensor, the transmission torque sensor, and the transmission torque status sensor may generate a transmission gear value, a transmission gear status value, a transmission torque value, and a transmission torque status value, respectively. Similarly, the left pedal position sensor, the left pedal position status sensor, and the transmission output speed status sensor generates a left pedal position value, a left pedal position status value, and a transmission torque output speed status value, respectively.

Further, the third net of sensors 70 is in communication with the lift cylinders 36 of the machine 10. The third set of sensors 70 detects various operating parameters of the lift cylinders 36. In one example, the third set of sensors 70 may include, but are not limited to, a lift float sensor, a lift linkage angle sensor, a lift linkage angle status sensor, a lift cylinder velocity sensor, a lift cylinder velocity status sensor, a pump pressure sensor, and a pump pressure status sensor. Again, it may be contemplated by a person skilled in the art that one or more of such sensors may be eliminated by determining corresponding values by indirect means. Based on the detection, the third set of sensors 70 generates a second set of input data associated with the lift cylinders 36 of the machine 10. For example, the lift float sensor, the lift linkage angle sensor, the lift linkage angle status sensor, the lift cylinder velocity sensor, the lift cylinder velocity status sensor, the pump pressure sensor, and the pump pressure status sensor may generate a lift float value, a lift linkage angle value, a lift linkage angle status value, a lift cylinder velocity value, a lift cylinder velocity status value, a pump pressure value, and a pump pressure status value, respectively.

The detected pump discharge pressure, the first set of input data, and the second set of input data are transmitted to the controller 60. The controller 60 includes a processor 72, an interface 74, and a memory 76 coupled to the processor 72. The processor 72 is configured to fetch and execute computer readable instructions stored in the memory 76. In one example, the processor 72 may be implemented as one or more microprocessors, microcomputers, microcontrollers, digital signal processors, central processing units, state machine, logic circuitries or any devices that manipulate signals based on operational instructions.

The interface 74 facilitates multiple communications within wide variety of protocols and networks, such as network, including wired network. Further, the interface 74 may include a variety of software and hardware interfaces. The interfaces 74 facilitate multiple communications within wide variety of protocols and networks, such as network, including wired network. In one example, the interface 74 may include one or more ports for connecting the controller 60 to an output unit (not shown).

In one example, the memory 76 may include any non-transitory computer-readable medium known in the art. In one example, the non-transitory computer-readable medium may be a volatile memory, such as static random access memory and anon-volatile memory, such as read-only memory, erasable programmable ROM, and flash memory.

The controller 60 also includes modules 78 and data 80. The modules 78 include routines, programs, objects, components, data structures, etc., which perform particular tasks or implement particular abstract data types. In one embodiment, the modules 78 include a data receiving module 82, a determining module 84, and a controlling module 86. The data 80 inter alia includes repository for storing data processed, received, and generated by one or more of the modules 78. The data 80 includes a determining data 88 and a controlling data 90.

The data receiving module 82 receives the detected pressure of the accumulator 42, the first set of input data, and the second set of input data from the first set of sensors 66, the second set of sensors 68, and the third set of sensors 70, respectively. In one example, details pertaining to the data receiving module 82 may be stored in the determining data 88.

Further, the determining module 84 determines whether the detected pressure of the accumulator 42 is above the threshold pressure value. In one example, when the pressure of the accumulator 42 is determined to be greater than the threshold pressure value, the determining module 84 determines the working mode of the ride control system 24. In other example, the determining module 84 determines the working mode even when the pressure of the accumulator 42 is below the threshold pressure value.

The determining module 84 determines the working mode of the ride control system 24 based on at least one of the first set of input data and the second set of input data. In the present embodiment, the determining module 84 determines the working mode as one of the normal mode and the exposed mode. In one example, a range of values of each of the first set of input data and the second set of input data are predefined corresponding to the normal mode as well as the exposed mode. The pre-defined ranges of the first set of input data and the second set of input data are set based on parameters such as, but are not limited to, a capacity of the accumulator 42 and operating conditions of the machine 10. The determining module 84 compares the first set of input data and the second set of input data with the predefined range of the first set of input data and the second set of input data. Based on the comparison, the determining module 84 determines the working mode of the ride control system 24. In one example, details pertaining to the determining module 84 may be stored in the determining data 88.

For example, the values for the pump discharge pressure and the pressure at the head end chamber 56 may be categorized as corresponding "low", "medium" and "high" ranges. In one exemplary condition, the ride control system 24 may be determined to be in the normal mode when the pump discharge pressure or pressure at the accumulator 42 is in a corresponding "medium" range, the pressure at the head end chamber 56 is also within corresponding "medium" to "high" range; and in such case, the ride control system 24 may be activated. In another exemplary condition, the ride control system 24 may be determined to be in the exposed mode when the pump discharge pressure or pressure at the accumulator 42 is in a corresponding "high" range, the pressure at the head end chamber 56 is in a corresponding "high" range; and in such case, the ride control system 24 may be deactivated. It may be contemplated by a person skilled in the art that the determining module 84 may include numerous such conditions covering various aspects of the working of the machine 10.

Based on the pump discharge pressure or the pressure detected at the accumulator 42, and the working mode of the ride control system 24, the controlling module 86 operates the ride control activation solenoid valve 62. In one example, based on the pressure and the working mode, the controlling module 86 generates a control signal for controlling the ride control activation solenoid valve 62. The control signal is indicative of an activation or deactivation of the ride control system 24. In one example, the control signal is a pulse having values "0" and "1" for a deactivate state and an activate state of the ride control system 24, respectively. Based on the control signal, the solenoid 64 of the ride control activation solenoid valve 62 is energized, which would in turn open the ride control activation solenoid valve 62. Consequently, the ride control activation solenoid valve 46 is switched to the open-state allowing the hydraulic fluid to flow from the lift cylinders 36 to the accumulator 42 and the accumulator relief valve 44.

For example, when the determining module 84 determines that the working mode of ride control system 24 is the normal mode and the pressure at the accumulator 42 is above the predefined threshold value, the controlling module 86 generates a control signal having a value "1", which is indicative of the activation of the ride control system 24. Therefore, the ride control activation solenoid valve 62 switches the ride control activation spool 46 to the open-state allowing the hydraulic fluid to flow from the lift cylinders 36 to the accumulator 42 and the accumulator relief valve 44. In one example, details of the controlling module 86 may be stored in the controlling data 90.

Figure 4:
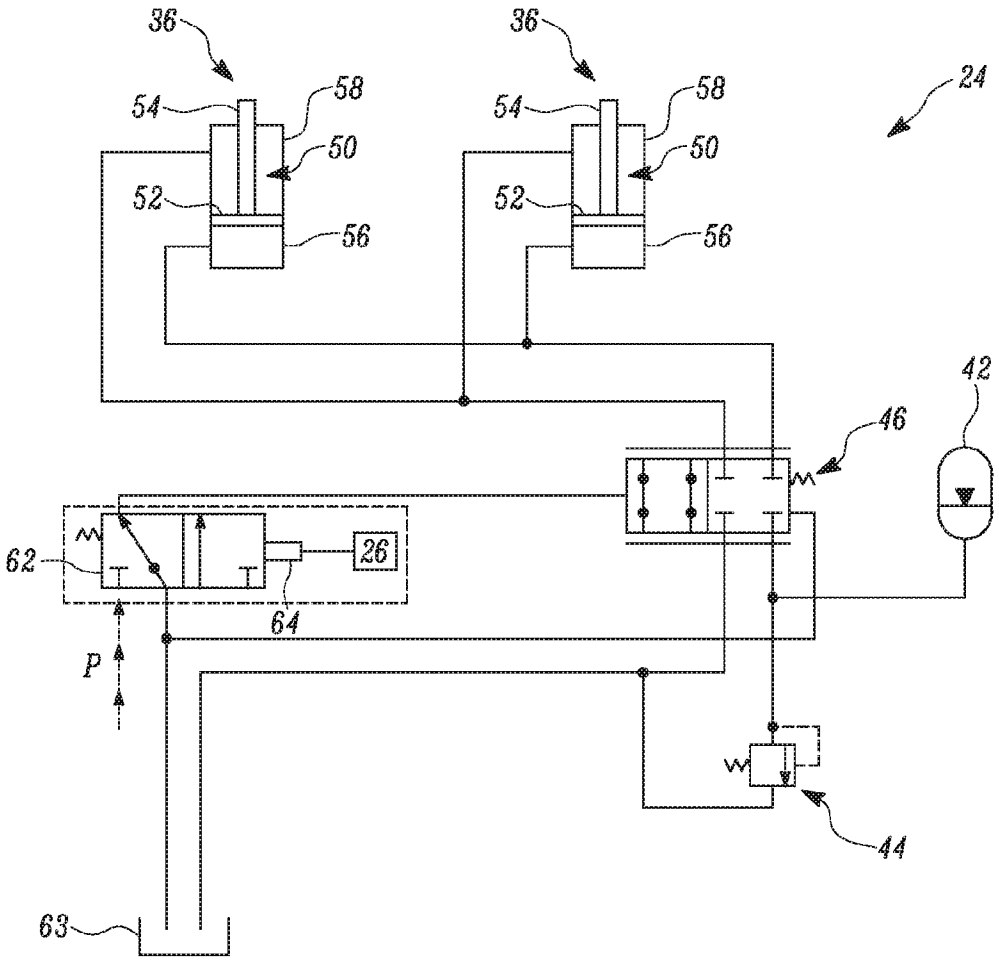
FIG. 4 is a schematic diagram of the ride control system with the regulating unit of the machine of FIG. 1, when the ride control system is operating in an exposed mode, according to an embodiment of the present disclosure.

FIG. 4 illustrates a schematic diagram of the ride control system 24 with the regulating unit 26 of the machine 10, when the ride control system 24 is operating in the exposed mode. In the present embodiment, the controlling module 86 determines that working mode of the ride control system 24 is the exposed mode and the pressure at the accumulator 42 is above the predefined threshold. In such an example, the controlling module 86 generates the control signal having the value "0", which is indicative of the deactivation of the ride control system 24. In order to deactivate the ride control system 24, the controlling module 86 de-energizes the solenoid 64, which would in turn close the ride control activation solenoid valve 62. The closing of the ride control activation solenoid valve 62 in turn switch the ride control activation spool 46 to the closed-state thereby blocking the flow of hydraulic fluid from the lift cylinders 36 to the accumulator 42 and the accumulator relief valve 44. In one example, upon de-energization of the solenoid 64, the pilot flow "P" from the ride control activation solenoid valve 62 is not provided to the ride control activation spool 46.

In the exposed mode of working of the ride control system 24, the lifting of the implement system 22 can cause high pressure in the head end chamber 56, when lifting against a large object. Likewise, the lifting of the implement system 22 can cause high pressure in the head end chamber 56 when there is a continuing command to lift at the maximum extension of the lift cylinders 36. When this high pressure in the head end chamber 56 is above the predefined threshold, the ride control activation spool 46 is closed and therefore exposure of the high pressure to the accumulator 42 and the accumulator relief valve 44 is prevented.

In an exemplary scenario of operation of the machine 10 when the implement 34 comes in contact with other materials, such as, but not limited to, a large pile of rock, and when there is simultaneous operator input to use the drive system of the machine 10 to move the implement 34 into the other materials, such as the large pile of rock, the forces on the on the lift cylinder can be very high and therefore creating high lift head end pressures. By sensing an amount of torque that the drive system is transferring to the ground, and sensing the ground speed and changes in the ground speed, it can be determined that the machine 10 is operating in a situation that may cause high lift head end pressures (i.e. above predefined threshold). Once this condition is detected (exposed mode) the ride control activation spool 46 may be closed so that the accumulator 42 and accumulator relief valve 44 are isolated from the high pressure. The pressurized hydraulic fluid in the head end chamber 56 is directed to the fluid reservoir 63 or any other hydraulic component of the machine 10, through a main implement valve (not illustrated), without limiting the scope of the present disclosure.

INDUSTRIAL APPLICABILITY

The present disclosure relates to a method 92 of operating the ride control system 24 of the machine 10. The method 92 protects the ride control system 24 by selective activation and deactivation of the ride control system 24. The method 92 prevents the ride control system 24 from being exposed to undesirable high pressures resulting from implement 34 and sustained lift cylinder stall. The controller 60 determines the working mode of the ride control system 24 and allows the ride control system 24 to be exposed to high pressures, when the working mode of the ride control system 24 is the normal mode.

Figure 5:
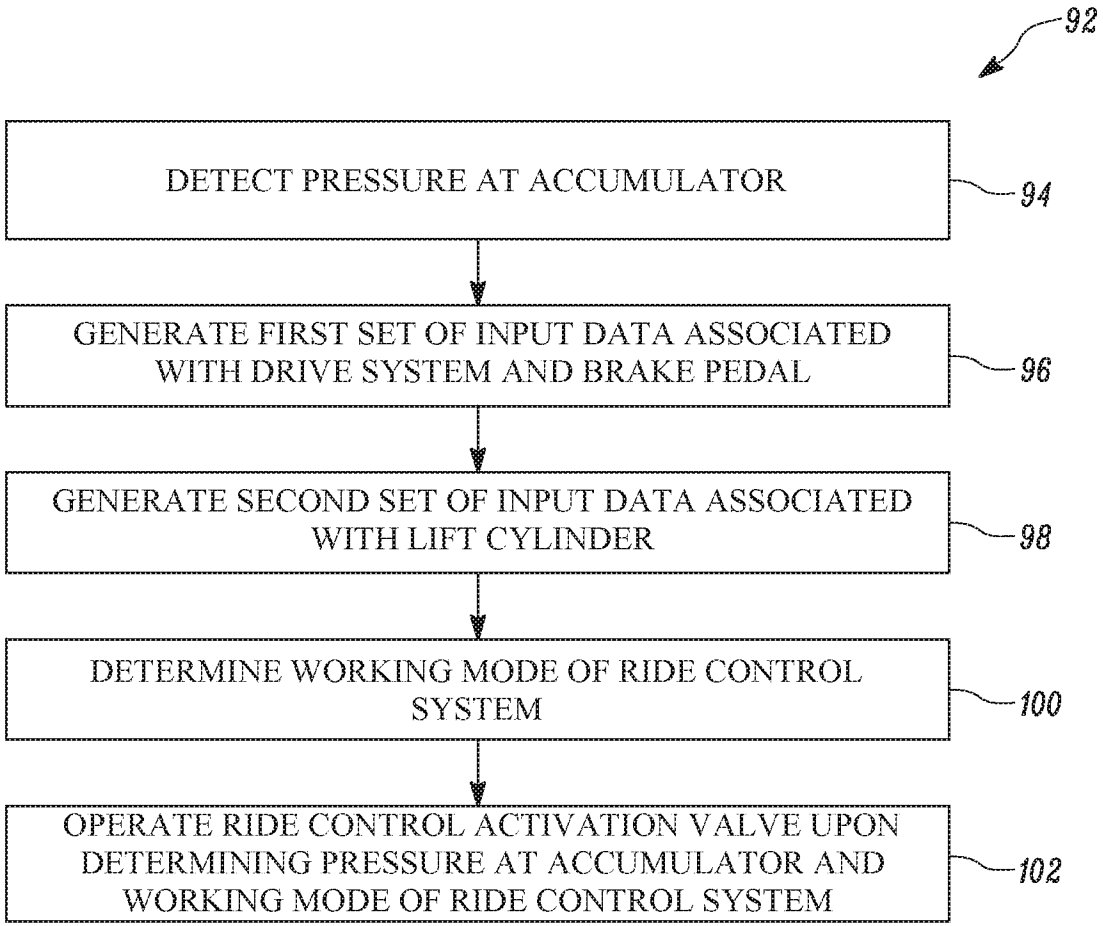
FIG. 5 is a flow chart illustrating a method of operating the ride control system of the machine, according to an embodiment of the present disclosure.

Referring to FIG. 5, the method 92 of operating the ride control system 24 of the machine 10 is illustrated. At step 94, the pressure at the accumulator 42 is detected by the first set of sensors 66. At step 96, the second set of sensors 68 generates the first set of input data. The first set of input data is associated with the drive system of the machine 10 and/or the brake pedal of the machine 10. At step 98, the third set of sensors 70 generates a second set of input data. The second set of input data is associated with the lift cylinder 36 of the machine 10. At step 100, the controller 60 determines the working mode of the ride control system 24, as discussed above. The working mode of the machine 10 is determined based on at least one of the first set of input data and the second set of input data. The working mode includes the normal mode and the exposed mode. Further, at step 102, the ride control activation solenoid valve 62 is operated upon determining the pressure at the accumulator 42 to be above a predefined threshold, and the working mode of the ride control system 24 to be the exposed mode. The operation of the ride control activation solenoid valve 62 selectively activates and deactivates the ride control system 24.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A method of operating a ride control system of a machine having an accumulator, the method comprising:

detecting, by a first set of sensors, a pressure at the accumulator;

generating, by a second set of sensors, a first set of input data associated with a pressure in a drive system of the machine and a brake pedal of the machine;

generating, by a third set of sensors, a second set of input data associated with a lift cylinder of the machine;

determining, by a controller, a working mode of the ride control system, based on the first set of input data and the second set of input data, as one of a normal mode and an exposed mode, the normal mode including the pressure at the accumulator in a first range and a pressure at the head end chamber of the lift cylinder in a second range, and the exposed mode including the pressure at the accumulator in a third range greater than the first range and a pressure at the head end chamber of the lift cylinder in a fourth range greater than the second range; and operating a ride control activation solenoid valve, upon determining the pressure at the accumulator to be above a predefined threshold and the working mode of the ride control system to be the exposed mode, to deactivate the ride control system.

* * * * *